US006343598B1

(12) United States Patent
Pshenychny

(10) Patent No.: US 6,343,598 B1
(45) Date of Patent: Feb. 5, 2002

(54) AIR GUN

(76) Inventor: Valery Pshenychny, 477 Locust, Galesburg, IL (US) 61401

( * ) Notice: Subject to any disclaimer, the term of this patent is extended or adjusted under 35 U.S.C. 154(b) by 0 days.

(21) Appl. No.: 09/451,389

(22) Filed: Nov. 30, 1999

(51) Int. Cl.[7] ..... F41B 11/00

(52) U.S. Cl. ..... 124/63; 124/60; 124/64; 124/65; 124/71

(58) Field of Search ..... 124/63, 69, 80; 89/7

(56) References Cited

U.S. PATENT DOCUMENTS 1,240,989 A * 9/1917 Lefever
1,405,012 A * 1/1922 Schneider
1,692,555 A * 11/1928 Lewis
2,119,441 A * 5/1938 Price
2,150,288 A * 3/1939 Moller
2,299,073 A * 10/1942 Beasley
2,450,029 A * 9/1948 Wells
2,604,088 A * 7/1952 Wells
2,736,308 A * 2/1956 Ferrando et al.
3,763,843 A * 10/1973 Fisher et al.
3,810,455 A * 5/1974 Garmon, Jr.
3,999,533 A * 12/1976 Buckner
4,304,213 A * 12/1981 Jereckos
4,677,781 A * 7/1987 Lee
4,834,059 A * 5/1989 Moorehous et al.
4,844,046 A * 7/1989 Straub
4,865,009 A * 9/1989 Ford et al.
4,928,661 A * 5/1990 Bordt et al.
5,154,157 A * 10/1992 Goepfert
5,224,465 A * 7/1993 Milliman
5,341,790 A * 8/1994 Ebert
5,377,655 A * 1/1995 Arad
5,377,656 A * 1/1995 Lewinski
5,429,108 A * 7/1995 Hsieh
5,565,642 A * 10/1996 Heitz
5,617,837 A * 4/1997 Momirov
5,761,840 A * 6/1998 Martin et al.

FOREIGN PATENT DOCUMENTS

GB 2056635 A * 3/1981

* cited by examiner

*Primary Examiner*—Michael J. Carone
*Assistant Examiner*—Troy Chambers
(74) *Attorney, Agent, or Firm*—Eagle & Eagle

(57) ABSTRACT

The present invention is an improved air gun. A novel lever system is employed whereby great pressure is obtained with a single pump. The length of the gun is minimized by an improved breach design. A simple breach lever with a seal is used to open the breach for insertion of a pellet and then closed (sealed) and security. A faster firing mechanism is employed utilizing the air pressure to open the valve and when the chamber becomes depressurized, the mechanism automatically returns to its initial position, ready to accept another pump.

1 Claim, 7 Drawing Sheets

AIR GUN

BACKGROUND OF THE INVENTION

1. Field of the Invention

This invention relates to an air gun, specifically an air gun which would be used for target shooting. A unique single pump lever system is utilized. A sealing mechanism which seals the breach is also provided as is a rocker pin assembly for a quicker release of air.

2. Description of Related Art including information disclosed under 37 CFR 1.97 and 1.98

The Fischer U.S. Pat. No. 4,004,566 is a clip and indexing system for a gas-operated gun. This patent allows for visual inspection of the projectiles while they are loaded in the clip and also allows for a choice of two projectiles.

The Jereckos U.S. Pat. No. 4,304,213 is a pressure relief valve for a gas operated gun. This valve prevents over pressuring the chamber while reducing the possibility of insufficient pressure associated with other similar relief valves.

The Cagnoni U.S. Pat. No. 4,336,787 is an air gun with a pivoting tie rod connected to the piston.

The Sindel U.S. Pat. No. 4,756,297 is an air gun with a non-circular air pressure chamber.

The Straub U.S. Pat. No. 4,844,046 is an air gun with a pivoting tie rod and a slotted lever.

The Bordt U.S. Pat. No. 4,928,661 is a cocking devise for an air gun which incorporates a six point articulated linkage and either a pivoting air cylinder or a pivoting tie rod.

The Goepfert U.S. Pat. No. 5,154,157 is an air gun with two pressure cylinders, one high pressure and one low pressure, and a pressure release system to prevent over-pressurization.

The Heitz U.S. Pat. No. 5,565,642 is an air gun with a precision loading mechanism.

BRIEF SUMMARY OF THE INVENTION

The present invention is an air gun with a cylinder-style pump having a tie rod rigidly disposed on the piston. This advantageous set up is improved with a two piece lever system, the first lever piece (tether link) being pivotally attached to the gun on one end and pivotally attached to the second lever piece, said second piece being also pivotally attached to the tie rod. The length of this second lever piece gives a great deal of leverage, primarily at the end of the piston stroke when the pressure is greatest and the need for leverage is the greatest. Less effort is required. This second lever piece could also be the barrel of the gun. This air pump could be utilized outside of the air gun class; such as bicycle or basketball pumps or applications where high air pressure or high fluid pressure is needed.

Another aspect of this invention is the mechanism for loading the weapon. A single pellet is manually inserted into the breach. A small breach lever, pivotally mounted to the gun, is rocked forward sealing the breach. The second lever piece, used for pumping the gun, secures the seal. This system increases the length of the gun only minimally. The limiting factor being the length of the barrel.

The third aspect of this invention is the rocker pin configuration which speeds the opening of the air valve when the trigger is pulled. A spring holds the rocker pin in position to accept the trigger bar when no pressure is present. The trigger bar, once accepted by the rocker pin, will keep the pressure chamber sealed so as to enable the pressure chamber to accept pressure. After pressure is introduced into the chamber the difference in area between the top seal and bottom seal of the valve will cause a net force on the rocker pin in the downwardly direction. When the trigger is pulled the trigger bar is withdrawn from contact with the rocker pin, the aforementioned downward force will drive the valve pin down causing a sudden release of air into the space behind the pellet. Speed is desirable and this rocker pin configuration is extremely fast.

DETAILED DESCRIPTION OF THE INVENTION

Figure 1:
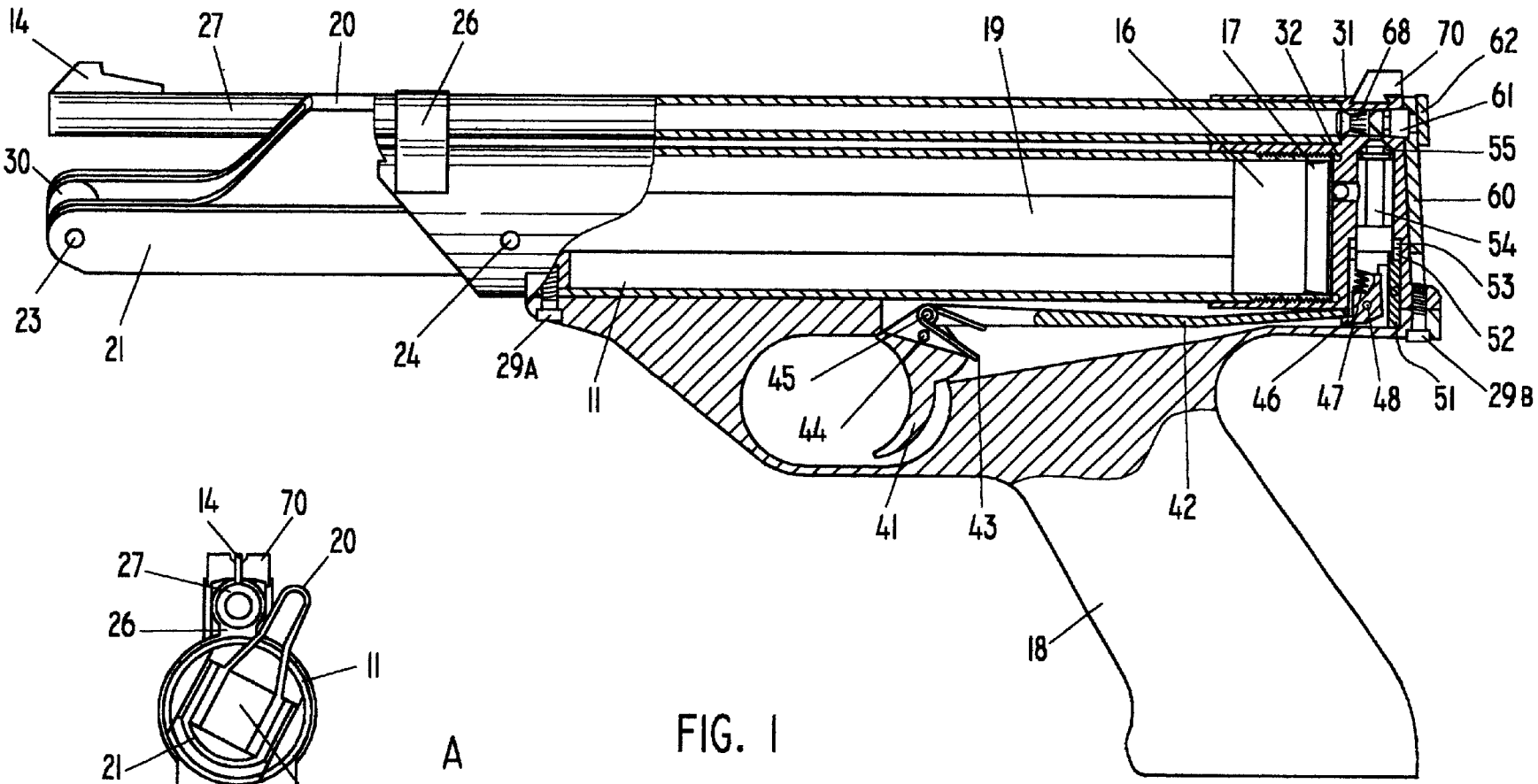
FIG. 1 is a side view with a portion cut away.
Figure 2:
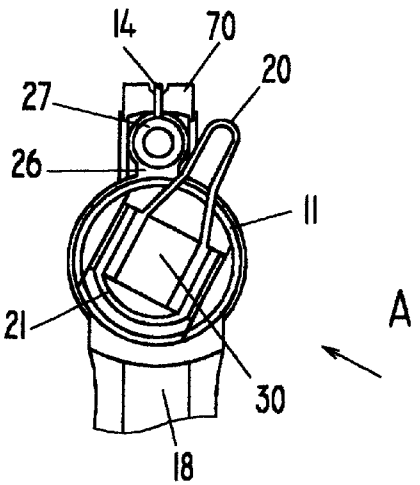
FIG. 2 is a front view with the lever shown in the diagonal embodiment.
Figure 5:
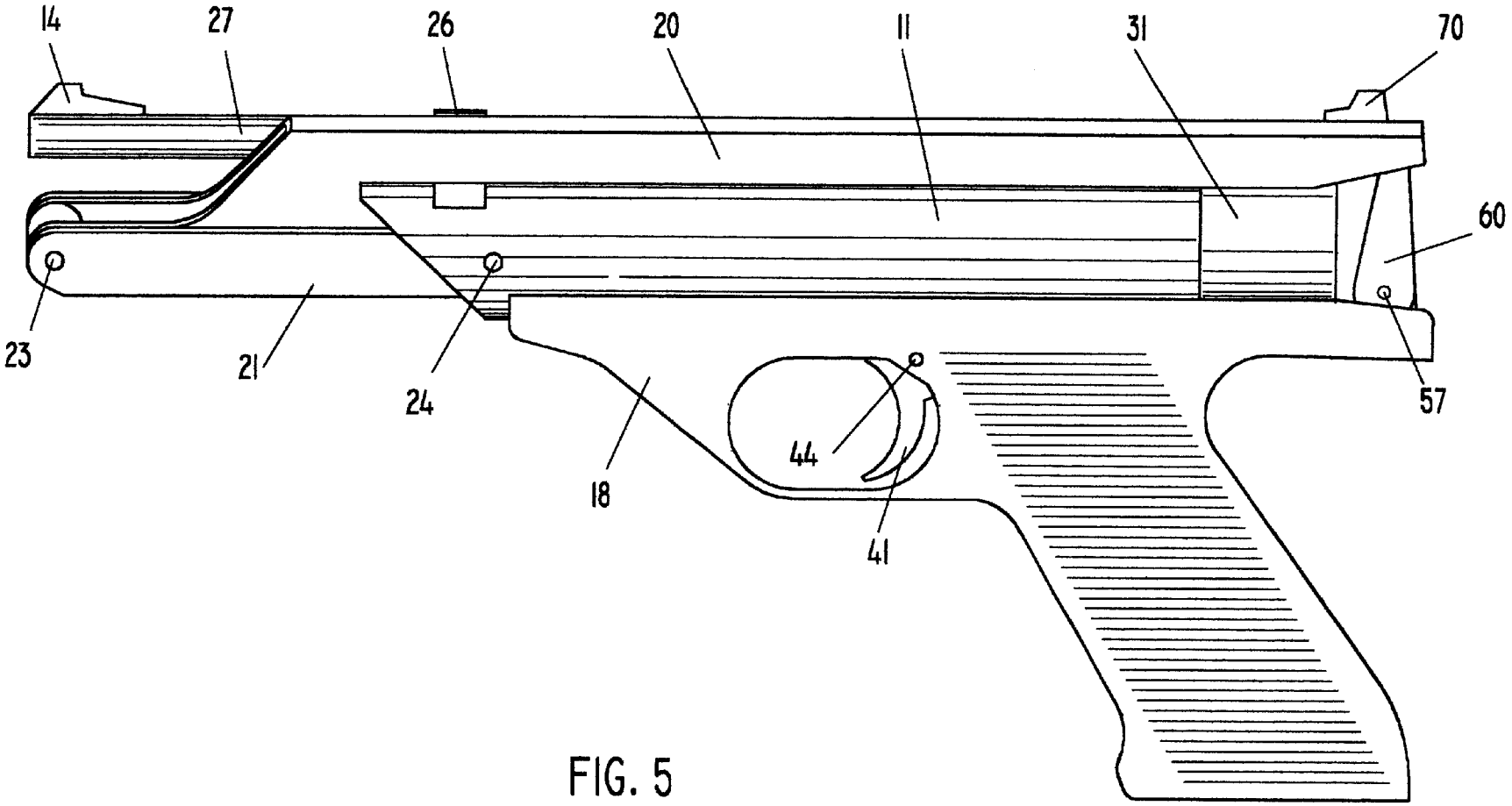
FIG. 5 is a side view of the air gun.
Figure 11:
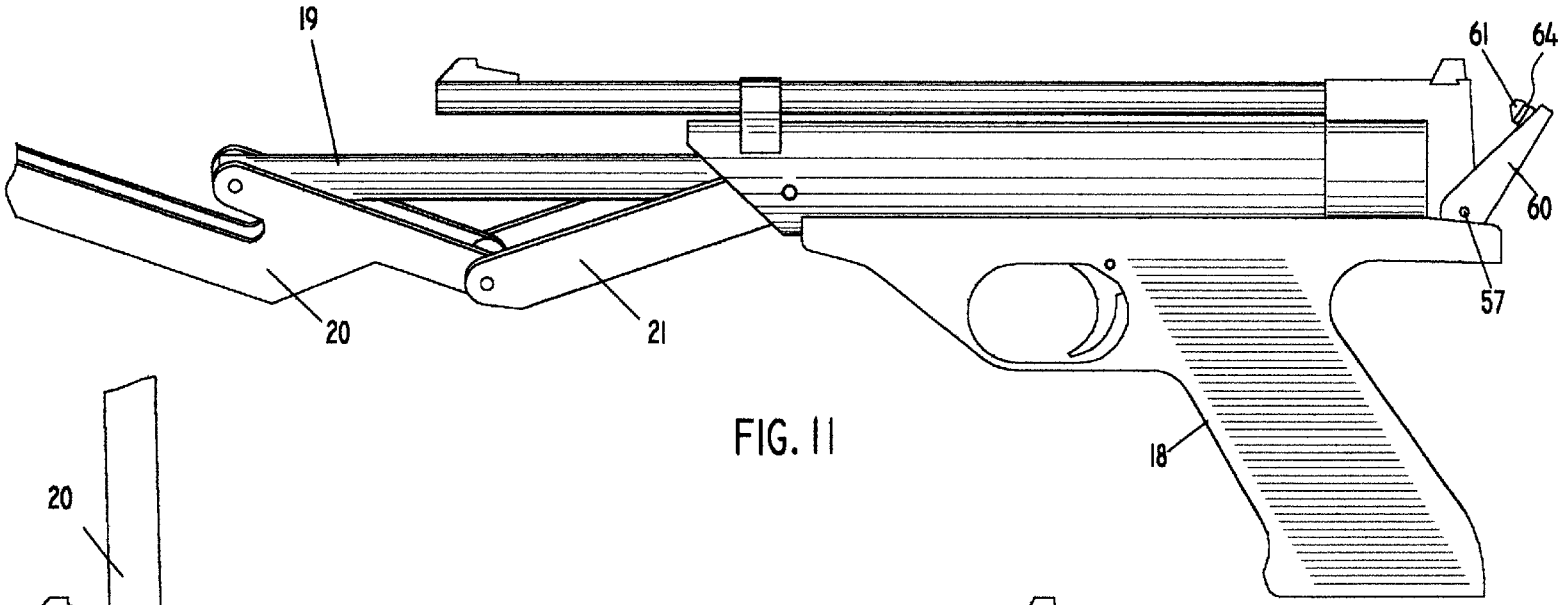
FIG. 11 is a side view of the gun with the lever extended.
Figure 12:
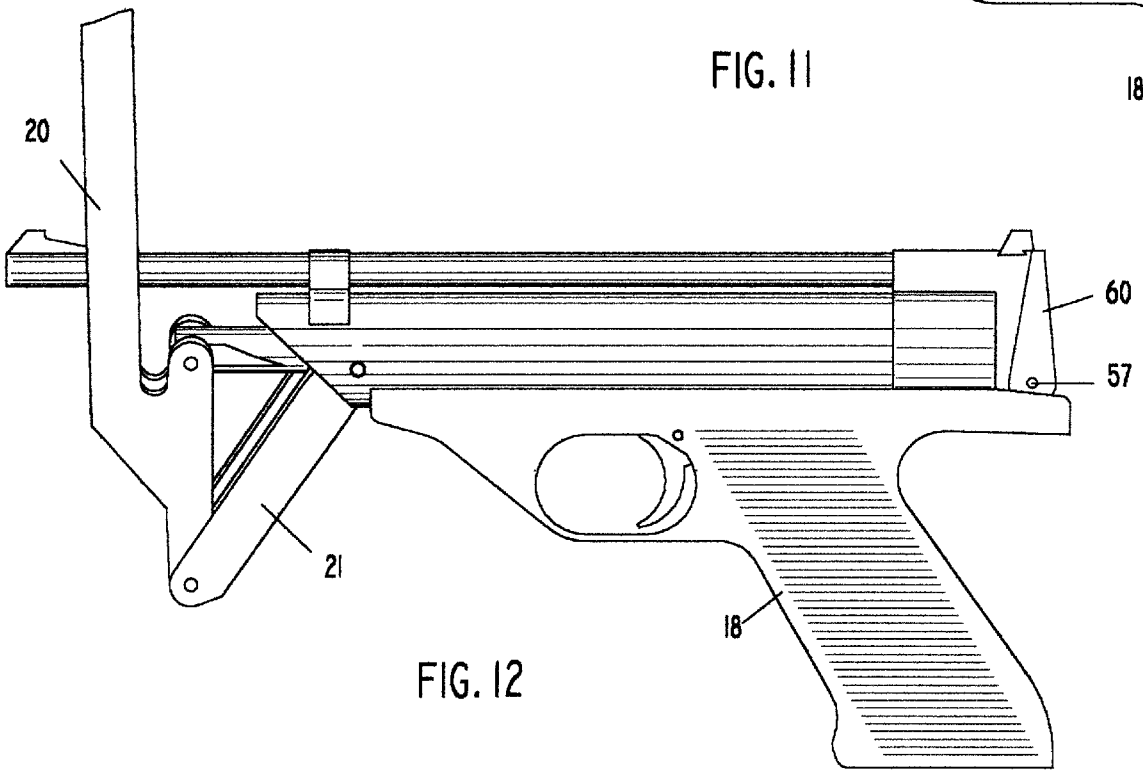
FIG. 12 is a side view of the gun with the lever in mid-travel.

Referring generally to FIGS. 5, 11 and 12 and particularly to FIG. 1, the instant invention has a barrel 27 with a front sight 14 rigidly disposed thereon and a cylinder 11. Preferably the cylinder is threaded into a block 31 and the barrel 27 is pressure fitted into the block 31. Said block 31 is made to accept both the barrel 27 and the cylinder 11 and the rocker pin configuration explained more fully below when referring to FIG. 2. The block 31 also has a rear sight 70 rigidly disposed thereon. An O-ring seal 32 is provided to seal the cylinder 11 to the block 31.

A fastener 26 is used to further secure the barrel 27 and the cylinder 11 together. Inside the cylinder 11 is a piston 16 with a seal 17. A rod 19 is rigidly attached to the piston 16. A front boss 12 is provided as a guide for the rod 19. Said boss 12 also serves as an anchor point for screw 29a and pin 24.

Figure 3:
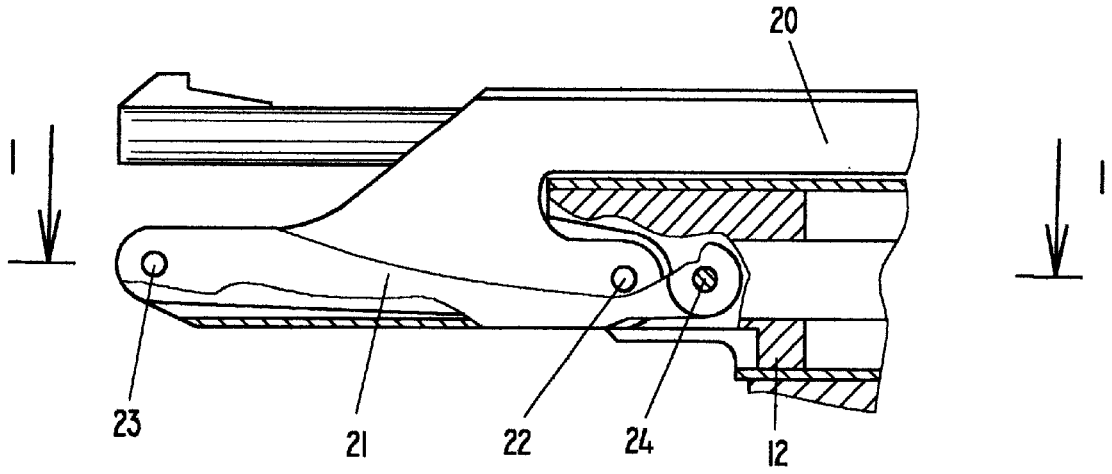
FIG. 3 is a view of the front portion of the gun from direction A (referenced in FIG. 2) with a portion cut away.
Figure 4:
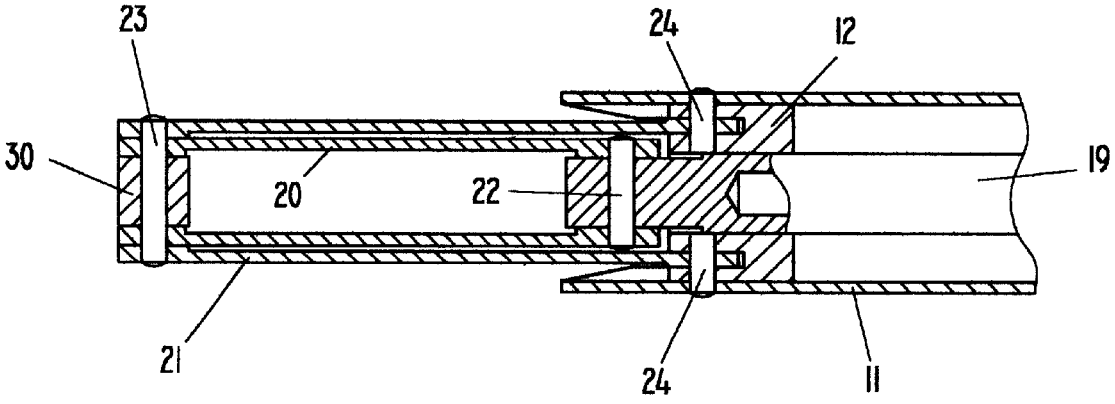
FIG. 4 is a sectional view in plane 1—1 (referenced in FIG. 3).
Figure 6:
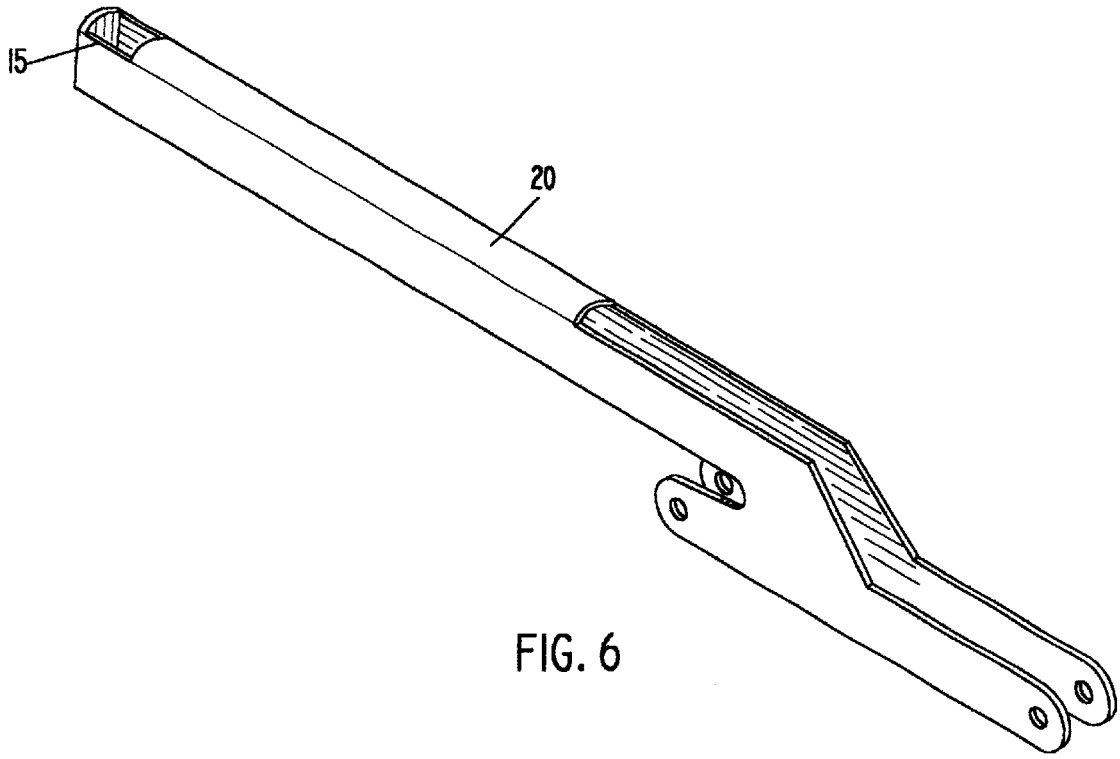
FIG. 6 is an isometric view of an alternative lever.
Figure 7:
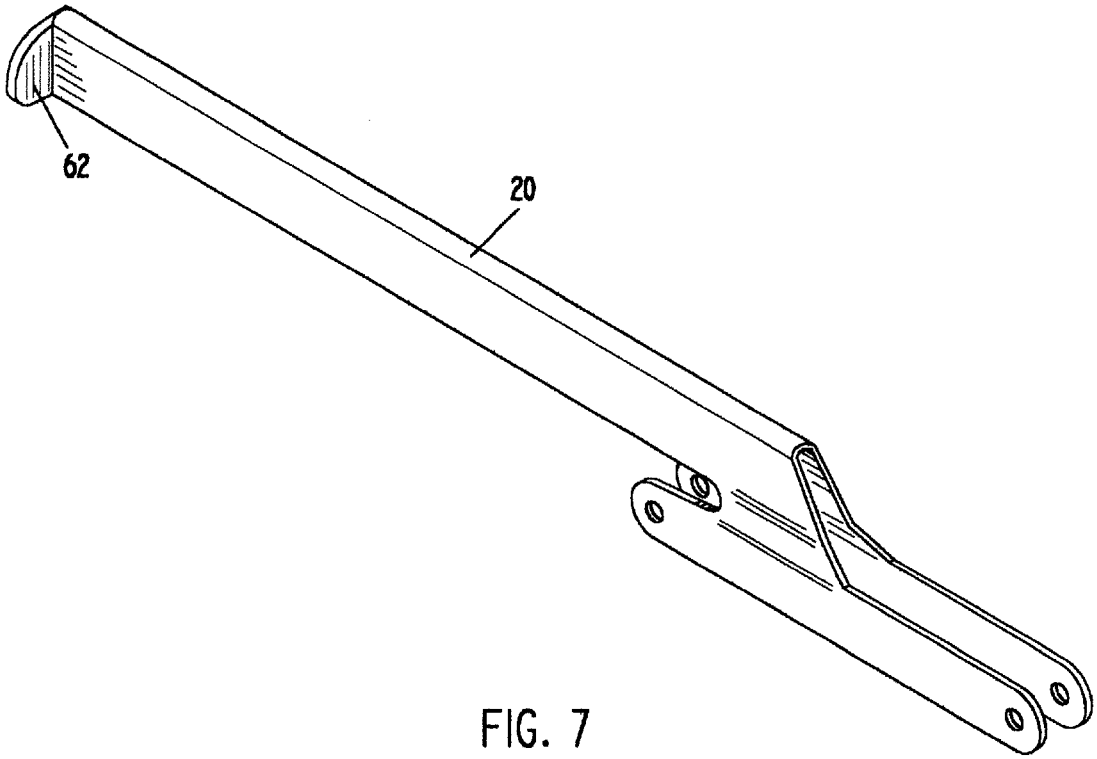
FIG. 7 is an isometric view of preferred lever.

Referring to FIGS. 1, 3 and 4, attached to the cylinder 11, or the front boss 12, is a tether link 21, pivotally attached by a pin 24. This tether link 21 preferably has a u-shaped cross section. The other end of the tether link 21 is pivotally attached to the lever 20 (depicted alone in FIGS. 6 & 7) by means of pin 23. A spacer 30 is used to strengthen this pivot point. A u-shaped cross section is preferable for the lever 20. A slot 15 could be provided on the lever to accommodate the rear sight 70, or the lever could be diagonal as depicted in FIG. 9. The diagonal configuration is more desirable because it enables the attachment of a scope. The lever 20 is also pivotally attached to the rod 19 with another pin 22. When rocking the lever 20 forward the piston 16 is likewise moved forward as in FIG. 8.

A prototype has been built whereby the barrel 27 is not fastened with the fastener 26 nor attached to the flange 31, but rather the barrel 27 and the lever 20 are one in the same. This is not preferred due to minor deformation that may occur in the barrel 27.

Referring to FIG. 1, a handgrip 18 is provided with a cutout for housing the trigger. The handgrip 18 is attached to the cylinder 11, or the front boss 12, in front by means of a screw 29*a,* and attached to the block 31 by means of another screw 29*b.*

The trigger 41 is pivotally attached to the handgrip 18 by means of a pin 44. A spring 43, shown in compression, is pivotally attached to the trigger 41 and the trigger bar 42 by means of a pin 45. When the trigger 41 is depressed the pin 45 and the trigger bar 42 move forward. The spring 43, which also moves forward, causes the trigger 41 to return forward when the trigger 41 is let go.

Figure 8:
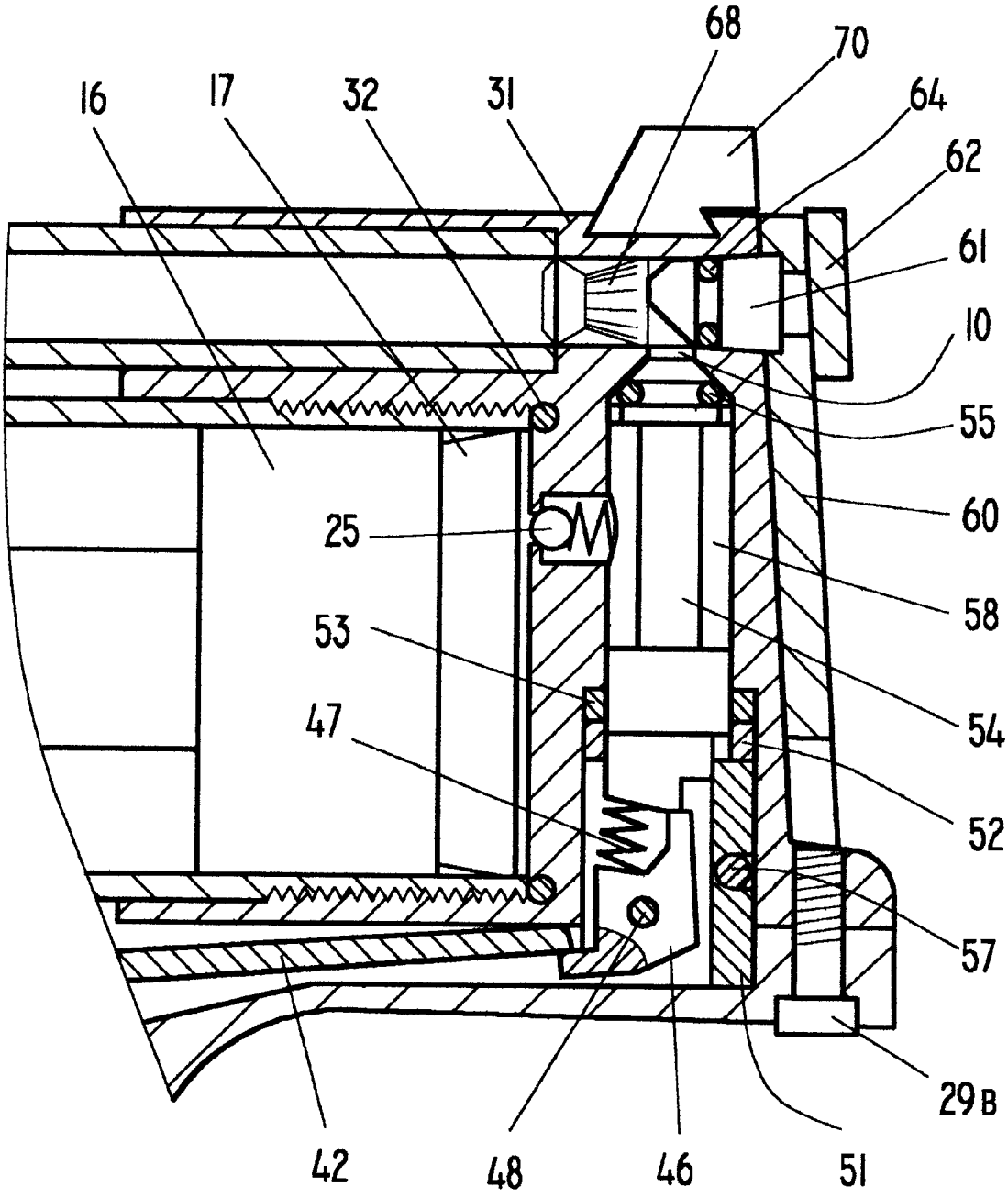
FIG. 8 is a side view, cut away, of the rocker pin configuration and breach lever.
Figure 9:
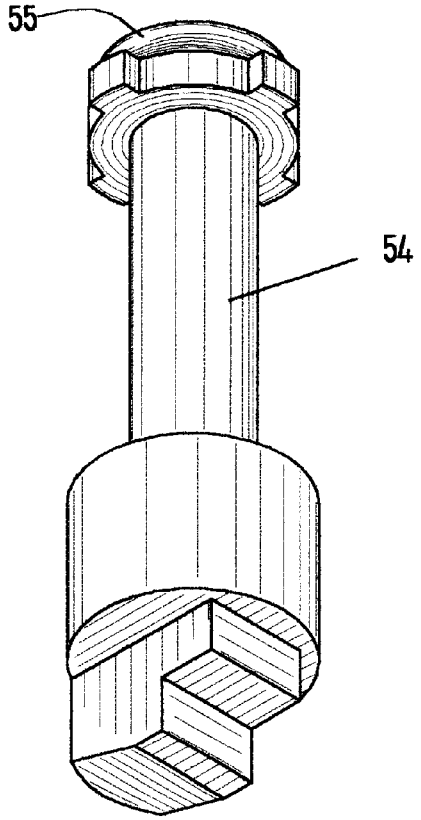
FIG. 9 is an isometric view of the valve.
Figure 10:
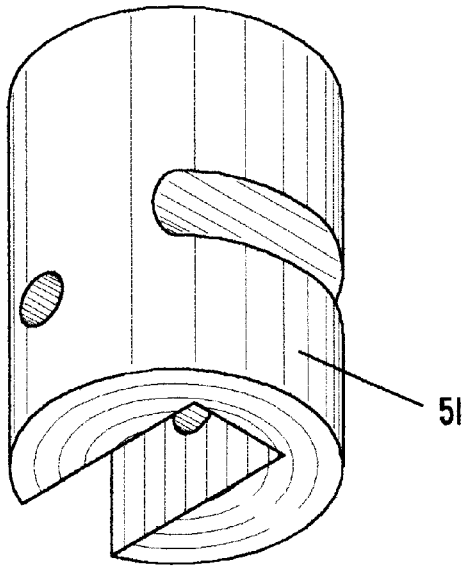
FIG. 10 is an isometric view of the spacer.

Referring specifically to FIGS. 8, 9 and 10, a unique valve configuration is employed. The valve 54 forms a seal 55 against the block 31 except when the trigger 41 is depressed with air pressure in the block 31. When the lever 20 is moved to full extension, a small hole (not shown) in the cylinder 11 allows the pressure (vacuum) in the cylinder to be brought to ambient pressure. The hole is positioned on the cylinder such that when the lever 20 begins its travel backward the piston 16 immediately moves past the hole and pressure is built up in the cylinder 11. As the piston 16 travels back the pressure gets extreme (approximately 2,000–2,500 psi) the leverage obtained by the lever 20 is likewise at its greatest. A check valve 25 between the piston 16 and the hollow of the block would allow the hollow of the block 31 to become pressurized. The check valve 25 would allow for multiple pumping, however, multiple pumping is unnecessary with this invention. With pressure in the hollow of the block 31 (i.e. chamber 58), the valve 54 exerts a force downward on the rocker 46 (due to the difference in area, top to bottom) but does not move until the trigger 41 is pulled and the trigger bar 42 loses contact with the rocker 46. The rocker then rotates clock-wise slightly, the seal 55 is lost and air rushes through the orifice 10. After the air escapes, the spring 47 moves the valve 54 up, reproduces the seal 55 and repositions the rocker 46. A lower seal 52 is secured in the block 31 by a ring 53 and prevents air pressure from escaping the chamber 58. A spacer 51 houses the rocker 46 and spring 47. The rocker 46 is pivotally connected to the spacer 51 by means of a pin 48. A dual purpose pin 57 sets the spacer 51 in the block and also pivotally attaches the breach cover 60 to the block 31.

Referring to FIGS. 1, 5 and 8, the breach cover 60 can only be moved when the lever 20 leaves its resting position. Once the lever 20 is moved, the breach cover 60 can be pivoted away from the breach (the bore of the barrel 27). A pellet 68 can then be manually inserted into the breach. A seal 61 is rigidly disposed on said breach cover 60 so that when the breach cover is closed, the barrel 27 is sealed in the back. It is preferred to dispose a rubber o-ring 64 onto said seal. If the lever 20 is cycled and brought back to its resting position, the breach lock 62 locks the breach cover 60 into place and secures the breach.

I claim:

1. An air gun comprising:

a cylinder housing having a front end, a back end and an interior wall;

a portion of said interior wall being cylindrical;

a piston movable in said cylinder housing to compress the gas therein;

a rod connected to said piston;

a tether link having a first end and a second end;

the first end of said tether link being pivotally attached to said front end of said cylinder housing at a first connection site and the second end of said tether link being pivotally attached to a lever at a second connection site wherein the second connection site is at a greater distance from the back end of the cylinder housing than the first connection site; and, said lever being pivotally attached to said rod at a third connection site wherein the third connection site is at a greater distance from the back end of the cylinder housing than the first connection site and wherein the lever is not directly connected to the cylinder housing.

* * * * *